US005301497A

United States Patent [19]

Leupers

[11] Patent Number: 5,301,497

[45] Date of Patent: Apr. 12, 1994

[54] DEVICE FOR CONVEYING FULL AND EMPTY BOBBINS BETWEEN MULTI-POSITION TEXTILE MACHINES

[75] Inventor: Wolfgang Leupers, Mönchengladbach, Fed. Rep. of Germany

[73] Assignee: Palitex Project-Company GmbH, Krefeld, Fed. Rep. of Germany

[21] Appl. No.: 908,190

[22] Filed: Jul. 1, 1992

[30] Foreign Application Priority Data

Jul. 1, 1991 [DE] Fed. Rep. of Germany ..... 4121772

[51] Int. Cl.[5] ..... D01H 9/02

[52] U.S. Cl. ..... 57/281; 57/90; 242/35.5 A

[58] Field of Search ..... 57/281, 90; 242/35.5 A

[56] References Cited

U.S. PATENT DOCUMENTS

| | | | |
|---|---|---|---|
| 3,828,682 | 8/1974 | Klein | 57/281 X |
| 3,935,821 | 2/1976 | Maier et al. | 57/281 X |
| 4,634,066 | 1/1987 | Matsui et al. | 242/35.5 A |
| 4,784,255 | 11/1988 | Uchida | 242/35.5 A X |
| 4,846,618 | 7/1989 | Matsui | 242/35.5 A X |
| 4,856,270 | 8/1989 | Langen et al. | 57/281 |
| 4,979,360 | 12/1990 | Kallmann et al. | 57/281 |
| 5,179,829 | 1/1993 | Grecksch et al. | 57/281 |
| 5,185,993 | 2/1993 | Fritschi et al. | 57/281 |

*Primary Examiner*—Joseph J. Hail, III

*Attorney, Agent, or Firm*—Robert W. Becker & Associates

[57] ABSTRACT

A device for conveying full and empty bobbins between multi-position textile machines of different finishing stages is comprised of an endless conveying rail and an endless, driven conveying element. The endless conveying rail is common to all of the multi-position textile machines of different finishing stages, whereby at least two multi-position textile machines are connected by the endless conveying rail. The conveying element is connected to the endless conveying rail and comprises carriers for conveying the full and empty bobbins, the carriers being movable along the conveying rail.

3 Claims, 5 Drawing Sheets

DEVICE FOR CONVEYING FULL AND EMPTY BOBBINS BETWEEN MULTI-POSITION TEXTILE MACHINES

BACKGROUND OF THE INVENTION

The present invention relates to a device for conveying filled and empty bobbins between multi-position textile machines of different finishing stages, comprising an endless conveying rail that is common to all multi-position textile machines of different finishing stages, whereby carriers for the bobbins or bobbin tubes are conveyed along and between the multi-position textile machines on the conveying rail.

A device of the aforementioned kind is described in U.S. Pat. No. 3,828,682. The device is used to convey full bobbins manufactured on at least one first spinning machine to at least one second spinning machine provided with a bobbin creel for a subsequent manufacturing step and to transport the empty bobbin sleeves or tubes back to the at least one first spinning machine. In this known device one single conveying rail is provided between the different machines on which the bobbins, respectively, the bobbin tube carriers, especially in the form of slides or carriages, are conveyed in the same conveying direction. The bobbin carriers are moved along the conveying rail either by hand or by providing ascending and descending rail sections in the direction of movement. In the area of ascending rail sections a motor-driven conveying unit is provided, for example, in the form of an endless conveyor, which engages the individual carriers, respectively, carrier slide and moves it in an upward direction. As soon as the individual bobbin carriers, respectively, bobbin carrier slides, have reached the elevated rail plateau, they are moved due to gravity in a downward direction within the area of the adjacent descending rail sections.

The disadvantage of this known device is that the transportation flow along the conveying rail occurs in a stepwise manner. On the one hand, in the area of the differently ascending rail sections respective independent drive units are required, while, on the other hand, it is not reliably ensured that in a uniform manner bobbin carriers, respectively, bobbin carrier carriages will pass the individual work stations of the multi-position textile machines so that a uniform servicing of the individual work stations is not ensured.

In U.S. Pat. No. 4,979,360 a transporting and handling system for multi-position textile machines is described which comprises a plurality of rail systems which are connected to one another by switches, whereby in the area of each individual rail system an independent drive unit is provided in order to convey the movable bobbin carriers, respectively, bobbin carrier trains along the individual rail systems to the individual work stations of the multi-position textile machines. In this known device the adjacent arrangement of various conveying systems is based on the fact that simultaneous with the bobbin carrier, respectively, bobbin carrier trains at least one servicing unit for performing operating steps at individual work stations of the multi-position textile machines are provided, whereby the individual servicing units are designed to perform operating steps within the area of one of the machines of different finishing stages.

It is therefore an object of the present invention to provide a conveying device of the aforementioned kind which ensures between multi-position textile machines of different finishing stages a direct connection with uniform conveying, respectively, operating flow such that at the stations of each multi-position textile machine of different, manufacturing stages to be serviced essentially an uninterrupted flow of bobbins, respectively, bobbin tube carriers is provided.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The device for conveying full and empty bobbins between multi-position textile machines of different finishing stages according to the present invention is primarily characterized by an endless conveying rail, common to all of the multi-position textile machines of different finishing stages, with the endless conveying rail connecting directly at least two multi-position textile machines; and an endless, driven conveying element connected to the endless conveying rail, the conveying element comprising carriers for conveying the full and empty bobbins, the carriers being movable along the conveying rail.

It is preferable that the carriers are connected to the conveying element spaced at a defined distance from one another. It is furthermore expedient that the conveying element is an endless conveying chain comprising guide rollers that are supported at the conveying rail.

With the inventive embodiment a reliable conveying flow is ensured without the need for different driving, respectively, conveying elements, whereby transfer or intermediate stations, for example, in the form of two different rail systems connected by switches, or intermittently acting driving elements which cause a stepwise conveying of the bobbin carriers, respectively, bobbin tube carriers, are no longer required.

According to the present invention it is suggested that the bobbin carriers, respectively, bobbin tube carriers are connected to the endless conveying element at defined distances from one another whereby these distances preferably correspond to the dividing distance between neighboring work stations of the multi-position textile machines.

The endless conveyer element is preferably a conveying chain which is supported and guided via guide rollers in, respectively, at the endless conveying rail.

DESCRIPTION OF PREFERRED EMBODIMENT

The present invention will now be described in detail with the aid of several specific embodiments utilizing FIGS. 1 through 5.

Figure 1:
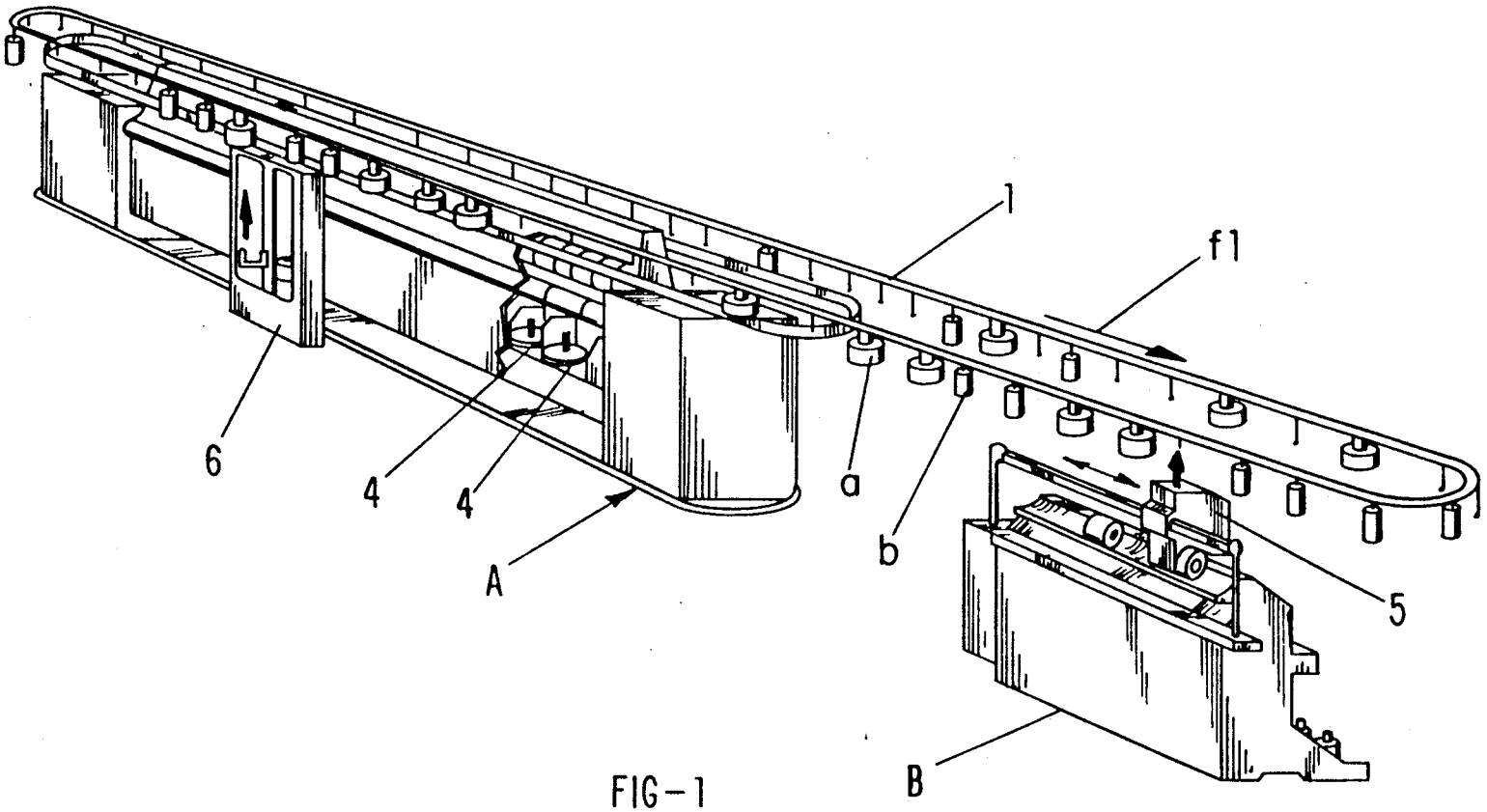
FIG. 1 shows a double twisting machine and a doubling machine connected by a single endless conveying rail.

The complete apparatus shown in FIG. 1 comprises a double twisting machine A and a doubling machine B connected by a single endless conveying rail 1. This conveying rail 1 is part of a suspended conveying system, the suspended conveying system further comprising an endless driven conveying element 2 (FIG. 5) which is guided along the conveying rail 1 and to which the individual bobbin carriers, respectively, bobbin tube carriers 3 are connected. In FIG. 1 the individual bobbin, respectively, bobbin tube carriers are represented essentially by bobbins a, respectively, bobbin tubes b.

The double twisting machine A has coordinated therewith a servicing unit 6 which serves to exchange empty bobbin tubes b and full bobbins a between the individual twisting stations, respectively, twisting spindles 4 and the conveying system 1, 2, 3. In a similar manner, the doubling machine B is provided with a servicing unit 5 which is not part of this invention.

The direction of movement of the endless conveying element 2 is indicated in FIG. 1 by the arrow f1. The individual bobbin carriers, respectively, bobbin tube carriers 3 are preferably connected to the conveying element 2 so as to be spaced at a distance which corresponds to the dividing distance of the double twisting machine whereby it is of no importance whether the individual bobbin carrier, respectively, bobbin tube carrier is loaded during the conveying step of the conveying element 2 with empty bobbin tubes b or full bobbins a. The transporting flow is designed such that the conveying element 2 is either continuously driven so that an exchange of bobbins or bobbin tubes may be performed manually, or intermittently driven so that an automated bobbin respectively bobbin tube exchange may be performed.

Figure 2:
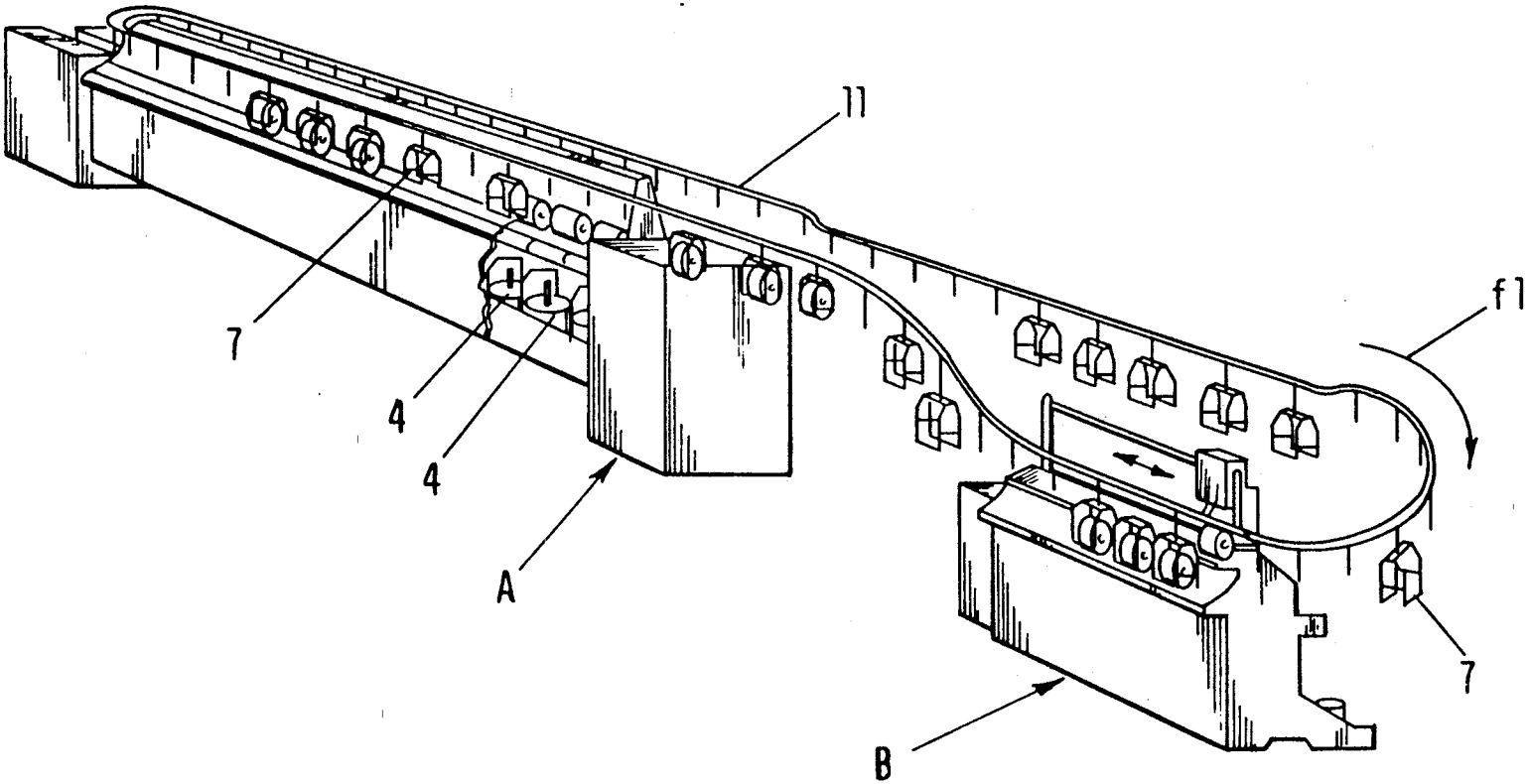
FIG. 2 shows a double twisting machine and a doubling machine connected by a different embodiment of a conveying rail.

In the complete apparatus according to FIG. 2 a double twisting machine A and a doubling machine B are connected by an endless conveying rail 11 which is provided with ascending, respectively, descending rail sections. The carriers for the bobbins, respectively, for the bobbin tubes provided for the bobbin transport have the form of transport cages 7 which are connected to the endless conveying element 2, for example, to the conveying chain 2 represented in FIG. 5. According to the representation of FIG. 2 filled an empty transport cages are randomly arranged at the conveying chain. The operating personnel at the double twisting machine A therefore have at all times a full bobbin available for operating the individual double twisting spindles 4. In this context it is irrelevant whether the double twisting machine is serviced in sections, i.e., spindle by spindle, or whether this servicing step is carried out randomly, i.e., only where a double twisting spindle is empty and a replacement is needed. The inventive transporting, respectively, conveying device also serves to remove the empty bobbin tubes b of the bobbins that have been used up at the double twisting spindle. The empty bobbin tubes are conveyed to the doubling machine B where they are transferred and again refilled with thread.

Figure 3:
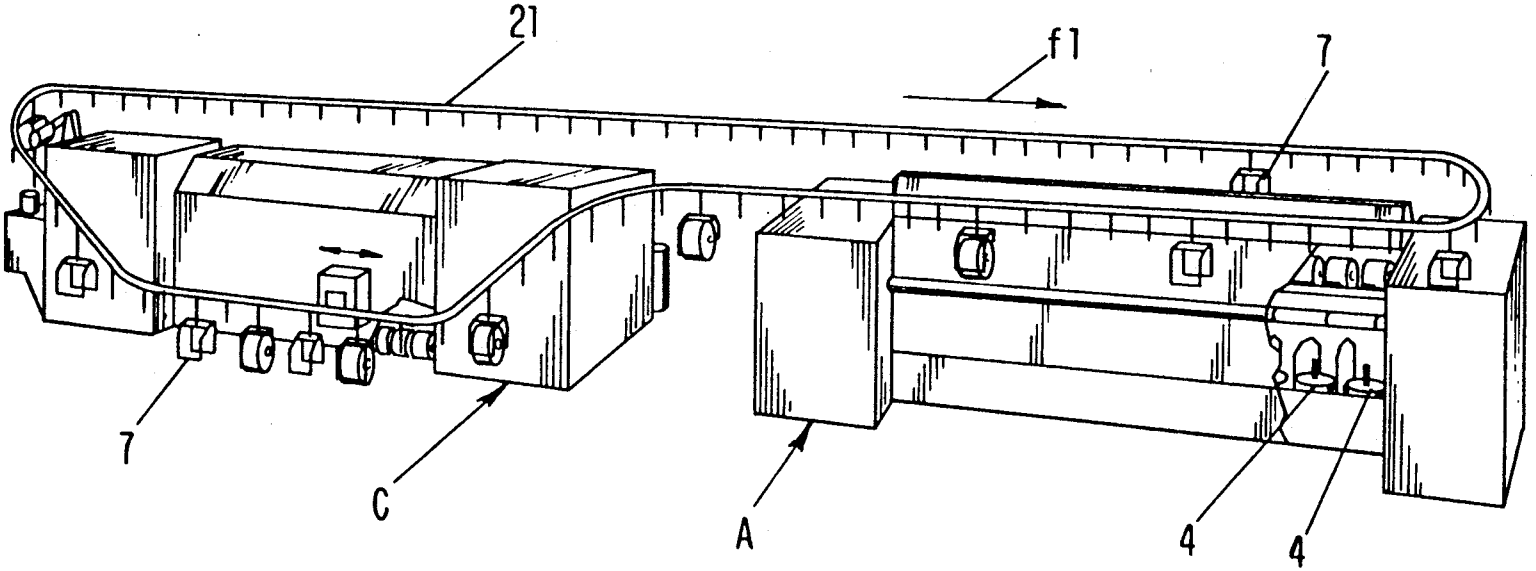
FIG. 3 is a schematic representation of a double twisting machine connected by an endless conveying rail to an air spinning machine.

FIG. 3 shows in a schematic representation a double twisting machine A which is connected by an endless conveying rail 21 to an air spinning machine C. This conveying rail 21 is also provided with descending and ascending rail sections. The bobbin carriers, respectively, bobbin tube carriers are also provided in the form of transport cages 7 which are connected to an endless conveying element (not represented in FIG. 3) which corresponds essentially to the endless conveying chain 2 shown in FIG. 5.

Figure 4:
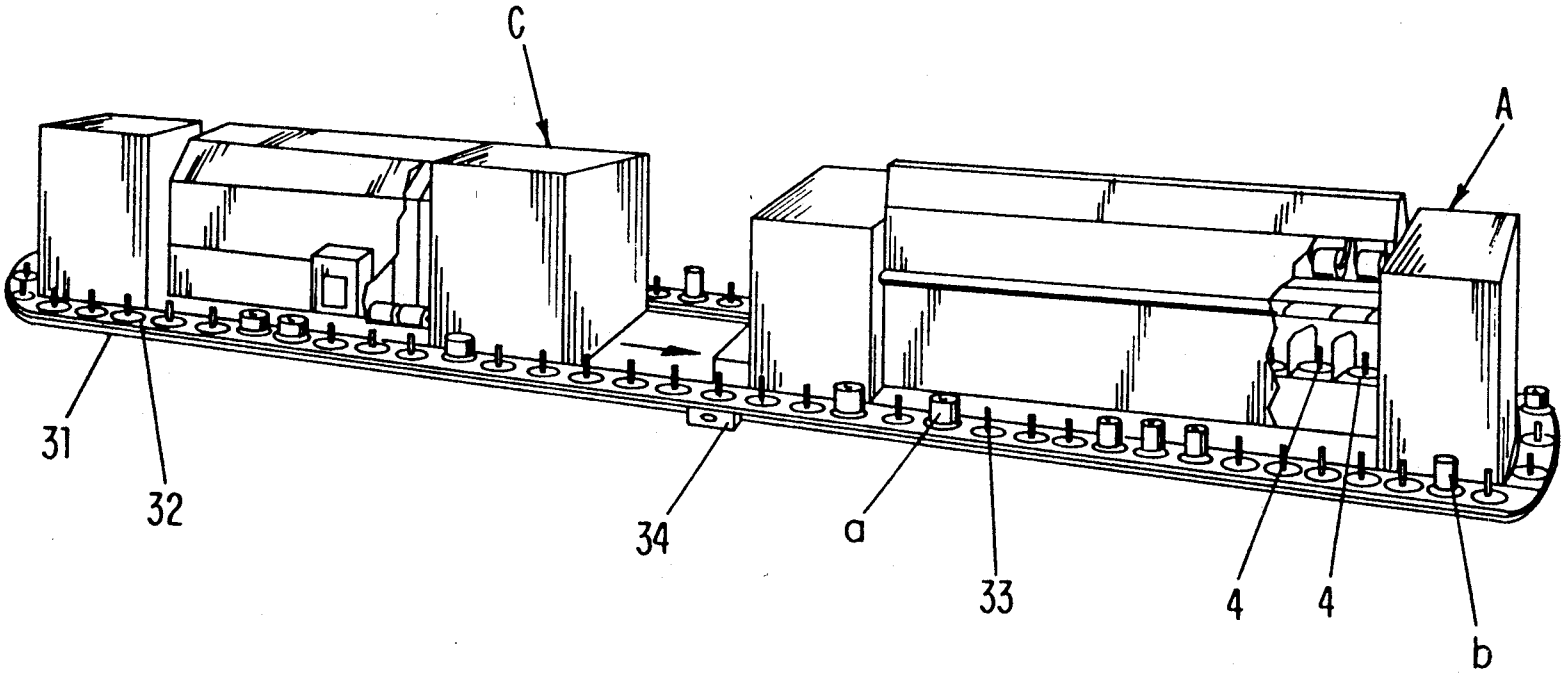
FIG. 4 shows another embodiment in which a double twisting machine is connected by an endless conveying rail to an air spinning machine.

The device represented in FIG. 4 is comprised of a double twisting machine A and an air spinning machine C connected by an endless conveying rail 31. In this case, the conveying rail 31 is arranged at the bottom portion of the machines and, as a transporting element, an endless transport belt 32 which is guided along the rail 31 is provided. The transport element has peg-shaped carriers 33 for placing thereon the full bobbins a, respectively, the empty bobbin tubes b. A drive unit 34 serves to drive the endless conveying belt 32.

Figure 5:
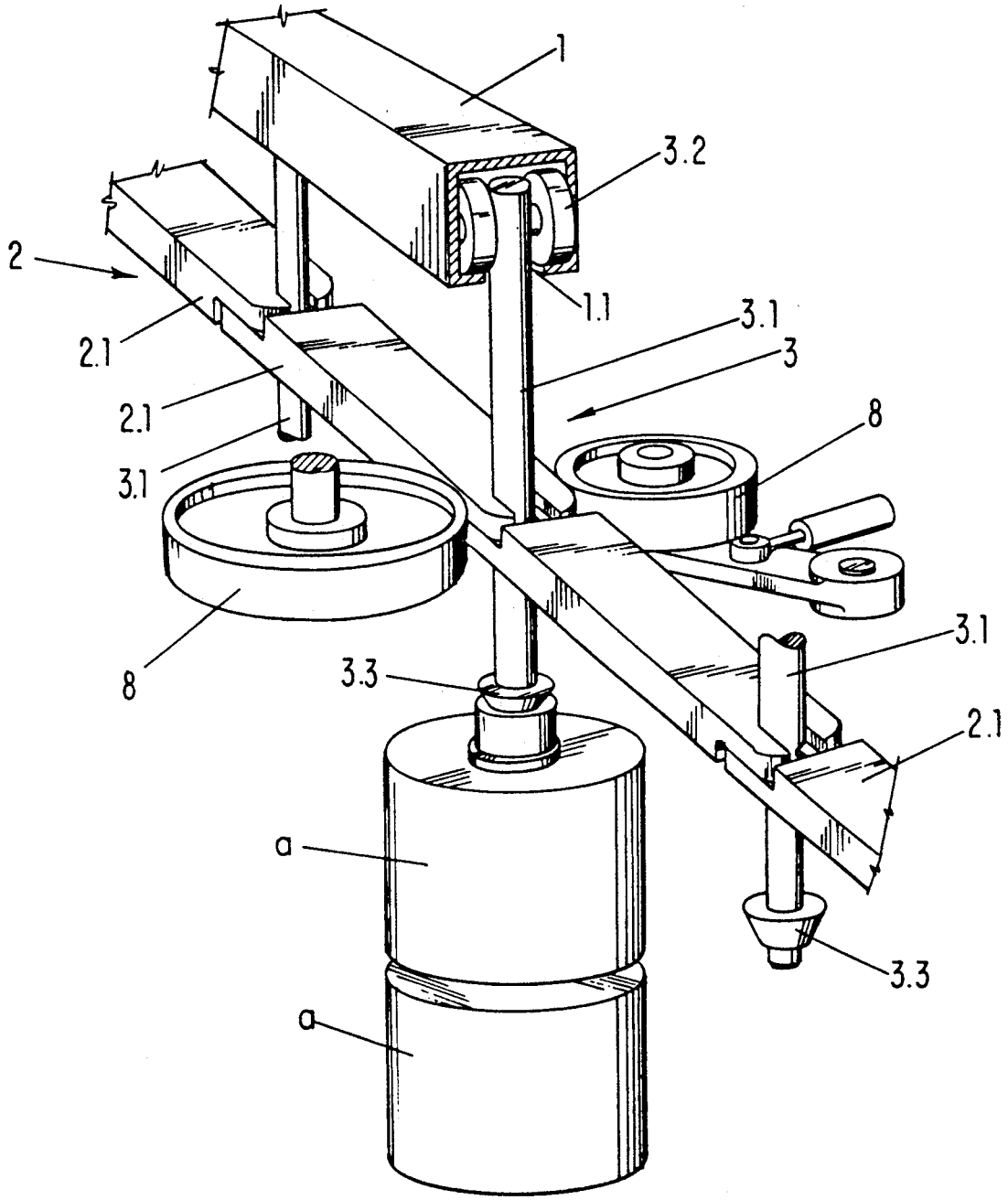
FIG. 5 shows a detail of an endless conveying rail with conveying element and carriers.

FIG. 5 shows a detail of the endless conveying rail 1 (the conveying rails 11 and 21 may correspond to this design) embodied as a hollow profiled rail with a slot 1.1 extending in the longitudinal direction of the conveying rail at its bottom portion. Each bobbin carrier, respectively, bobbin tube carrier 3 is provided with a carrier rod 3.1 which is inserted via the slot 1.1 into the hollow profile of the conveying rail 1 and is there suspended via guide rollers 3.2. At the bottom end of the carrier rod 3.1 a fastening device 3.3 for one or two bobbins a is provided. The carrier rod 3.1 is held between two end sections of adjacent chain members 2.1 such that during movement of the endless conveying chain 2 the individual carrier rods 3.1 are moved. The conveying chain 2 is driven by friction wheels 8 which are driven by a motor and laterally engage the conveying chain 2.

The present invention is, of course, in no way restricted to the specific disclosure of the specification and drawings, but also encompasses any modifications within the scope of the appended claims.

I claim:

1. A device for conveying full and empty bobbins between multi-position textile machines of different finishing stages, comprising:

an endless conveying rail, common to all of the multi-position textile machines of different finishing stages, with said endless conveying rail connecting directly at least two multi-position textile machines; and an endless, driven conveying element connected to said endless conveying rail and extending over an entire length of said endless conveying rail, said conveying element comprising carriers for conveying the full and empty bobbins, said carriers being movable along said conveying rail.

2. A device according to claim 1, wherein said carriers are connected to said conveying element spaced at defined distances from one another.

3. A device according to claim 1, wherein said conveying element is an endless conveying chain comprising guide rollers that are supported at said conveying rail.

* * * * *